US009718635B2

(12) United States Patent
Sato

(10) Patent No.: US 9,718,635 B2
(45) Date of Patent: Aug. 1, 2017

(54) POST-PROCESSING DEVICE AND IMAGE FORMING APPARATUS

(71) Applicant: FUJI XEROX CO., LTD., Tokyo (JP)

(72) Inventor: Ryuichi Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/138,278

(22) Filed: Apr. 26, 2016

(65) Prior Publication Data

US 2017/0137253 A1 May 18, 2017

(30) Foreign Application Priority Data

Nov. 18, 2015 (JP) ..... 2015-225526

(51) Int. Cl.
*B65H 31/26* (2006.01)
*B65H 31/34* (2006.01)
(Continued)

(52) U.S. Cl.
CPC ..... *B65H 31/34* (2013.01); *B65H 5/36* (2013.01); *B65H 9/106* (2013.01); *B65H 29/22* (2013.01); *B65H 29/36* (2013.01); *B65H 29/40* (2013.01); *B65H 29/52* (2013.01); *B65H 37/04* (2013.01); *G03G 15/6529* (2013.01);
(Continued)

(58) Field of Classification Search
CPC . B65H 5/36; B65H 5/38; B65H 9/004; B65H 9/04; B65H 9/10; B65H 9/103; B65H 9/106; B65H 29/22; B65H 29/26; B65H 29/36; B65H 29/38; B65H 29/40; B65H 29/52; B65H 31/00; B65H 31/02; B65H 31/34; B65H 37/04; B65H 2301/421; B65H 2301/4212; B65H 2301/42124; B65H 2404/1114; B65H 2404/63; B65H 2404/65; B65H 2404/653; B65H 2404/661; B65H 2405/11151; B65H 2405/11152; B65H 2405/20; B65H 2408/12; B65H 2408/121
See application file for complete search history.

(56) References Cited

U.S. PATENT DOCUMENTS 3,847,388 A * 11/1974 Lynch ..... G03G 15/6552 271/220
2004/0032073 A1* 2/2004 Sasamoto ..... B42C 1/12 271/3.03
(Continued)

FOREIGN PATENT DOCUMENTS

JP 2003-89462 A 3/2003
JP 2003-89463 A 3/2003
(Continued)

*Primary Examiner* — Prasad Gokhale
(74) *Attorney, Agent, or Firm* — Sughrue Mion, PLLC

(57) ABSTRACT

A post-processing device includes a stacking portion on which a medium having an image recorded thereon is stacked; an aligning portion that is disposed on the stacking portion and that aligns a position of an edge of the medium; a drawing member that draws the medium stacked on the stacking portion toward the aligning portion; and a guiding member that is disposed above the drawing member and that guides the medium that is transported toward the stacking portion, the guiding member including a vicinity portion that is in a vicinity of the drawing member and that is recessed so as to receive the drawing member.

3 Claims, 7 Drawing Sheets

(51) Int. Cl.

| | |
|---|---|
| ***G03G 15/00*** | (2006.01) |
| ***B65H 37/04*** | (2006.01) |
| ***B65H 5/36*** | (2006.01) |
| ***B65H 9/10*** | (2006.01) |
| ***B65H 29/22*** | (2006.01) |
| ***B65H 29/52*** | (2006.01) |
| ***B65H 29/36*** | (2006.01) |
| ***B65H 29/40*** | (2006.01) |

(52) U.S. Cl.
CPC *B65H 2404/1114* (2013.01); *B65H 2404/653* (2013.01); *B65H 2404/661* (2013.01)

(56) References Cited

U.S. PATENT DOCUMENTS

| | | | | |
|---|---|---|---|---|
| 2005/0230898 | A1* | 10/2005 | Suqiyama | B65H 9/106 270/58.08 |
| 2006/0017210 | A1* | 1/2006 | Sato | B27F 7/006 270/58.08 |
| 2007/0069453 | A1* | 3/2007 | Thomas | B65H 29/14 271/207 |
| 2008/0237964 | A1* | 10/2008 | Kiriyama | B42C 1/125 270/58.27 |
| 2016/0347568 | A1* | 12/2016 | Taki | B65H 29/44 |

FOREIGN PATENT DOCUMENTS

| | | | |
|---|---|---|---|
| JP | 2003-176077 | A | 6/2003 |
| JP | 2003-276933 | A | 10/2003 |
| JP | 2006-69746 | A | 3/2006 |
| JP | 2006-69749 | A | 3/2006 |
| JP | 2013-133200 | A | 7/2013 |

* cited by examiner

POST-PROCESSING DEVICE AND IMAGE FORMING APPARATUS

CROSS-REFERENCE TO RELATED APPLICATIONS

This application is based on and claims priority under 35 USC 119 from Japanese Patent Application No. 2015-225526 filed Nov. 18, 2015.

BACKGROUND

Technical Field

The present invention relates to a post-processing device and an image forming apparatus.

SUMMARY

According to an aspect of the invention, there is provided a post-processing device including a stacking portion on which a medium having an image recorded thereon is stacked; an aligning portion that is disposed on the stacking portion and that aligns a position of an edge of the medium; a drawing member that draws the medium stacked on the stacking portion toward the aligning portion; and a guiding member that is disposed above the drawing member and that guides the medium that is transported toward the stacking portion, the guiding member including a vicinity portion that is in a vicinity of the drawing member and that is recessed so as to receive the drawing member.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings. However, the present invention is not limited to the following exemplary embodiment.

To facilitate understanding of the following description, in each figure, the front-back direction, the left-right direction, and the up-down direction are defined as the X-axis direction, the Y-axis direction, and the Z-axis direction, respectively. In addition, the directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "X" marks therein show the direction from front to back with respect to the sides illustrated in the figures.

In each figure, components other than those necessary for explanation are omitted to facilitate understanding.

Overall Structure of Printer U of Exemplary Embodiment

Figure 1:
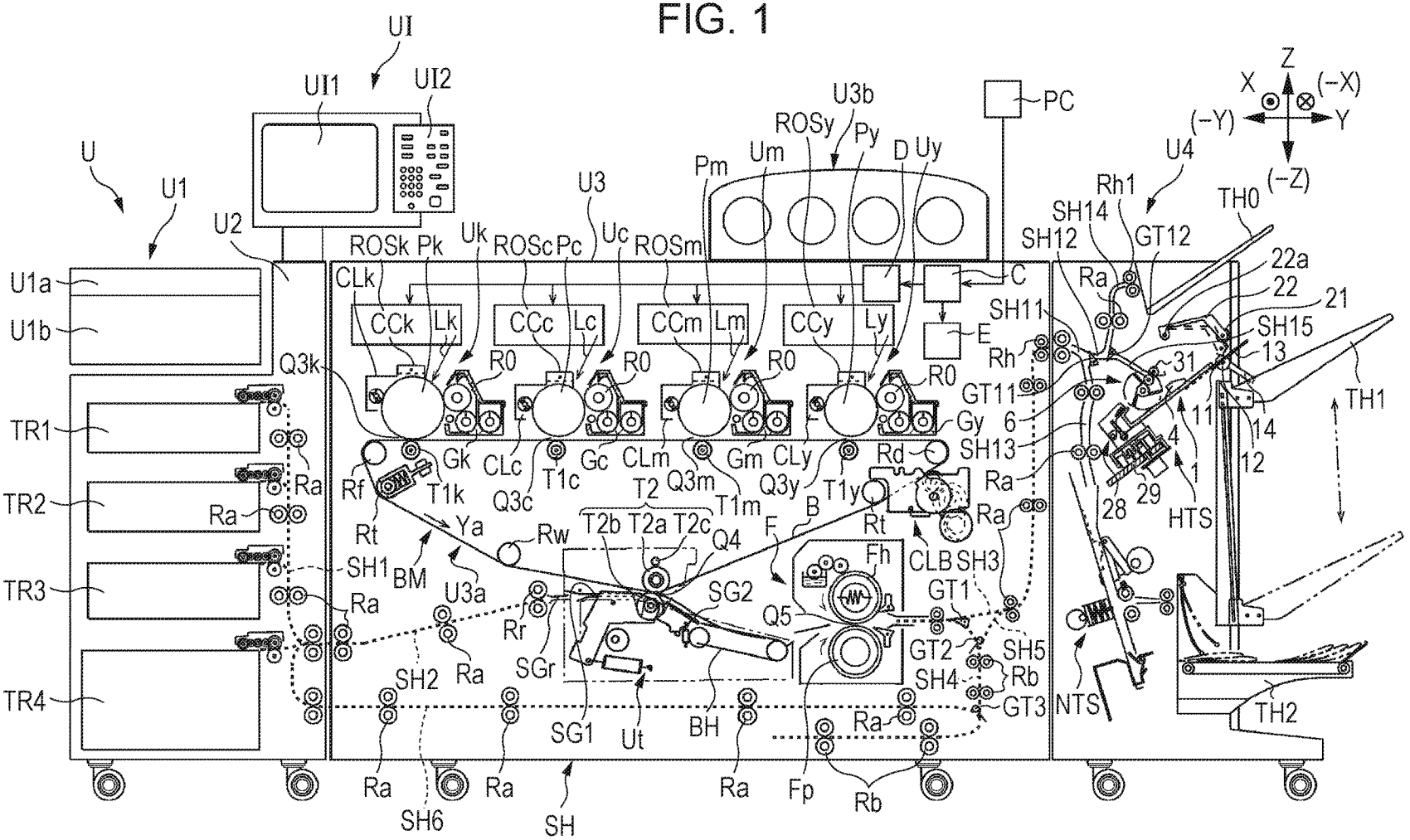
FIG. 1 illustrates the overall structure of an image forming apparatus according to an exemplary embodiment of the present invention.

FIG. 1 illustrates the overall structure of an image forming apparatus according to an exemplary embodiment of the present invention.

In FIG. 1, a printer U, which is an example of an image forming apparatus according to the exemplary embodiment, includes a scanner unit U1 as an example of an image-information reading device. A sheet feeding device U2, which is an example of a medium supplying device, is provided below the scanner unit U1. A printer body U3, which is an example of an image forming apparatus body, is disposed on the right side of the sheet feeding device U2. A finisher U4, which is an example of a post-processing device, is disposed on the right side of the printer body U3. A user interface UI, which is an example of an operation unit, is supported at a location above the sheet feeding device U2.

The user interface UI includes a display panel UI1 as an example of a display, and an input button unit UI2 including a copy start key, numeric keys, and a copy-number input key.

The scanner unit U1 includes a document feeder U1*a* as an example of a document transporting device, and an image scanner U1*b* as an example of an image reading unit.

The sheet feeding device U2 includes plural sheet feeding trays TR1 to TR4 as examples of medium containers. Each of the sheet feeding trays TR1 to TR4 contains sheets S as examples of media. A supply path SH1, which is an example of a transport path, is provided in the sheet feeding device U2. The supply path SH1 connects the sheet feeding trays TR1 to TR4 to the printer body U3.

Structure of Image Recording Unit U3*a* of Exemplary Embodiment

In FIG. 1, the printer body U3 includes an image recording unit U3*a* that records an image on a sheet S. A toner dispenser U3*b*, which is an example of a developer supplying device, is disposed above the image recording unit U3*a*.

The printer body U3 includes a controller C as an example of a control unit. The controller C is electrically connected to a client personal computer PC, which is an example of an image information transmitter. The controller C receives image information or the like transmitted from the client personal computer PC. The controller C controls a laser driving circuit D, which is an example of an exposure-device driving circuit, and a power supply circuit E.

The laser driving circuit D outputs signals of image information for respective colors, which are yellow (Y), magenta (M), cyan (C), and black (K), to exposure devices ROSy, ROSm, ROSc, and ROSk for the respective colors Y, M, C, and K on the basis of the information input from the scanner unit U1 or the client personal computer PC at a preset timing.

Photoconductors Py, Pm, Pc, and Pk, which are examples of image carriers, are disposed below the respective exposure devices ROSy, ROSm, ROSc, and ROSk. In the exemplary embodiment, the black (K) photoconductor Pk, which is frequently used and whose surface easily wears, has a diameter greater than those of the photoconductors Py, Pm, and Pc for the other colors Y, M, and C. Accordingly, the black (K) photoconductor Pk is rotatable at a high speed, and has a long lifespan.

A charger CCk, which is an example of a charging device, is disposed above the black (K) photoconductor Pk. A developing device Gk is disposed downstream of the charger CCk in a rotational direction in which the photoconductor Pk rotates. The developing device Gk includes a developing roller RO as an example of a developer carrier. A first transfer roller T1*k*, which is an example of a first transfer device, is disposed downstream of the developing device Gk in the rotational direction of the photoconductor Pk. A cleaner CLk, which is an example of a photoconductor cleaning device, is disposed downstream of the first transfer roller Ilk in the rotational direction of the photoconductor Pk.

The photoconductor Pk, the charger CCk, and the cleaner CLk form a black (K) photoconductor unit Uk as an example of an image carrier unit according to the exemplary embodiment. Therefore, the photoconductor Pk, the charger CCk, and the cleaner CLk are formed integrally with each other and are detachably attached to the printer body U3. Similarly to the black (K) photoconductor unit Uk, photoconductor units Uy, Um, and Uc for the other colors are formed of photoconductors Py, Pm, and Pc, chargers CCy, CCm, and CCc, and cleaners CLy, CLm, and CLc.

The photoconductor units Uy, Um, Uc, and Uk and the developing devices Gy, Gm, Gc, and Gk constitute visible-image forming members Uy+Gy, Um+Gm, Uc+Gc, and Uk+Gk according to the exemplary embodiment.

A belt module BM, which is an example of an intermediate transfer device, is disposed below the visible-image forming members Uy+Gy, Um+Gm, Uc+Gc, and Uk+Gk.

The belt module BM includes an intermediate transfer belt B, belt support rollers Rd, Rt, Rw, Rf, and T2*a*, which are examples of intermediate-transfer-body support members, and first transfer rollers T1*y*, T1*m*, T1*c*, and T1*k*. The belt support rollers Rd, Rt, Rw, Rf, and T2*a* include a belt driving roller Rd, which is an example of an intermediate-transfer-body driving member; a tension roller Rt, which is an example of a tension applying member; a walking roller Rw, which is an example of a meandering preventing member; plural idler rollers Rf, which are examples of driven members; and a backup roller T2*a*, which is an example of an opposing member for a second transfer process. The intermediate transfer belt B is supported by the belt support rollers Rd, Rt, Rw, Rf, and T2*a* such that the intermediate transfer belt B is rotatable in the direction of arrow Ya.

A belt cleaner CLB, which is an example of an intermediate-transfer-body cleaning device, is disposed near the belt driving roller Rd.

A second transfer unit Ut is disposed below the backup roller T2*a*. The second transfer unit Ut includes a second transfer roller T2*b* as an example of a second transfer member. The region in which the second transfer roller T2*b* is in contact with the intermediate transfer belt B serves as a second transfer region Q4, which is an example of an image recording region. A contact roller T2*c*, which is an example of a voltage-applying contact member, is in contact with the backup roller T2*a*. A second transfer voltage having the same polarity as the charging polarity of the toner is applied to the contact roller T2*c* by the power supply circuit E, controlled by the controller C, at a preset timing.

The backup roller T2*a*, the second transfer roller T2*b*, and the contact roller T2*c* form a second transfer device T2 according to the exemplary embodiment. The first transfer rollers T1*y*, T1*m*, T1*c*, and T1*k*, the intermediate transfer belt B, and the second transfer device T2 constitute a transferring device T1+B+T2 according to the exemplary embodiment which transfers the images on the surfaces of the photoconductors Py to Pk onto the sheet S.

A feeding path SH2, which is an example of a transport path, is disposed below the belt module BM. The feeding path SH2 extends from the supply path SH1 of the sheet feeding device U2 toward the second transfer region Q4. Plural transport rollers Ra, which are examples of medium transporting members, are arranged along the feeding path SH2. In addition, a registration roller Rr is provided on the feeding path SH2 at a location upstream of the second transfer region Q4 in the transporting direction of the sheet S. The registration roller Rr is an example of an adjusting member that adjust a transport timing at which the sheet S is transported to the second transfer device T2. A guiding member SGr for guiding the medium is disposed downstream of the registration roller Rr in the transporting direction of the sheet S. The guiding member SGr for the medium is fixed to the printer body U3 together with the registration roller Rr. A guiding member SG1 for guiding the medium before the transfer process is disposed between the guiding member SGr for the medium and the second transfer region Q4.

A guiding member SG2 for guiding the medium after the transfer process is disposed downstream of the second transfer region Q4 in the transporting direction of the sheet S. A transporting belt BH, which is an example of a medium transporting member, is disposed downstream of the guiding member SG2 for guiding the medium after the transfer process in the transporting direction of the sheet S. A fixing device F is disposed downstream of the transporting belt BH in the transporting direction of the sheet S. The fixing device F includes a heating roller Fh, which is an example of a heating fixing member, and a pressing roller Fp, which is an example of a pressing fixing member. The region in which the heating roller Fh and the pressing roller Fp are in contact with each other serves as a fixing region Q5.

The visible-image forming members Uy+Gy to Uk+Gk, the transferring device T1+B+T2, and the fixing device F constitute the image recording unit U3*a* according to the exemplary embodiment.

An ejection path SH3, which is an example of a transport path, is disposed downstream of the fixing device F in the transporting direction of the sheet S. The ejection path SH3 extends rightward and upward from the downstream end of the feeding path SH2 in the transporting direction of the sheet S. The transport rollers Ra are arranged along the ejection path SH3. An ejection roller Rh, which is an example of a medium ejecting member, is disposed at the downstream end of the ejection path SH3 in the transporting direction of the sheet S.

An upstream end of a reversing path SH4, which is an example of a transport path, in the transporting direction of the sheet S is connected to a connecting portion between the feeding path SH2 and the ejection path SH3. The reversing path SH4 extends downward. Reversing rollers Rb, which are examples of medium reversing members and which are rotatable in forward and reverse directions, are arranged along the reversing path SH4. An upstream end of an ejecting-reversing path SH5, which is an example of a transport path, in the transporting direction of the sheet S is connected to the reversing path SH4 at an intermediate position thereof. The downstream end of the ejecting-reversing path SH5 in the transporting direction of the sheet S is connected to the ejection path SH3. An upstream end of a circulation path SH6, which is an example of a transport path, in the transporting direction of the sheet S is connected to the reversing path SH4 at an intermediate position thereof that is downstream of the position at which the reversing path SH4 is connected to the ejecting-reversing path SH5 in the transporting direction of the sheet S. The circulation path SH6 connects the reversing path SH4 to the supply path SH1 of the sheet feeding device U2. Transport rollers Ra are arranged along the circulation path SH6.

A switching gate GT1, which is an example of a destination switching member, is provided on a connecting portion between the feeding path SH2 and the ejection path SH3.

A Mylar gate GT2, which is an example of a transporting-direction regulating member, is provided on a connecting portion between the reversing path SH4 and the ejecting-reversing path SH5.

A Mylar gate GT3, which is also an example of a transporting-direction regulating member, is provided on a connecting portion between the reversing path SH4 and the circulation path SH6.

Elements denoted by SH1 to SH6 constitute a transporting path body SH according to the exemplary embodiment.

Operation of Image Recording Unit U3*a* of Exemplary Embodiment

When the controller C receives image information from the client personal computer PC or the scanner unit U1, the printer U starts a job, that is, an image forming operation. When the job is started, the photoconductors Py to Pk, the intermediate transfer belt B, and other components start to rotate.

The chargers CCy to CCk receive a preset voltage from the power supply circuit E, and charge the surfaces of the photoconductors Py to Pk.

The exposure devices ROSy to ROSk output laser beams Ly, Lm, Lc, and Lk, which are examples of latent-image-writing light, on the basis of signals from the laser driving circuit D. The surfaces of the photoconductors Py to Pk are irradiated with the laser beams Ly to Lk so that electrostatic latent images are formed thereon.

The developing rollers RO of the developing devices Gy to Gk develop the electrostatic latent images on the surfaces of the photoconductors Py to Pk into visible images.

The toner dispenser U3*b* supplies developers to the developing devices Gy to Gk when the developers in the developing devices Gy to Gk are consumed.

The power supply circuit E applies a first transfer voltage to the first transfer rollers T1*y* to T1*k*, the first transfer voltage having a polarity opposite to the charging polarity of the developers. Thus, the visible images on the surfaces of the photoconductors Py to Pk are transferred onto the surface of the intermediate transfer belt B.

The cleaners CLy to CLk clean the surfaces of the photoconductors Py to Pk by removing the developers that remain thereon after the first transfer process.

Y, M, C, and K images are transferred onto the intermediate transfer belt B in that order in a superimposed manner when the intermediate transfer belt B passes through the first transfer regions Q3*y* to Q3*k* that face the photoconductors Py to Pk, respectively. Then, the intermediate transfer belt B passes through the second transfer region Q4 that faces the second transfer device T2. When a monochrome image is to be formed, a single colored image is transferred onto the intermediate transfer belt B, and then the intermediate transfer belt B passes through the second transfer region Q4.

The sheet feeding trays TR1 to TR4 contain sheets S. A sheet S contained in one of the sheet feeding trays TR1 to TR4 is transported along the supply path SH1 of the sheet feeding device U2 by the transport rollers Ra, and fed to the feeding path SH2 of the printer body U3.

The sheet S fed to the feeding path SH2 is transported toward the registration roller Rr.

The registration roller Rr feeds the sheet S toward the second transfer region Q4 at the time when the image on the surface of the intermediate transfer belt B is transported to the second transfer region Q4.

In the second transfer device T2, the power supply circuit E applies a second transfer voltage to the backup roller T2*a* through the contact roller T2*c*. The second transfer voltage has the same polarity as the preset charging polarity of the developers. Therefore, the image on the intermediate transfer belt B is transferred onto the sheet S that passes through the second transfer region Q4.

The belt cleaner CLB cleans the surface of the intermediate transfer belt B by removing the developers that remain thereon after the image has been transferred in the second transfer region Q4.

The transporting belt BH holds the sheet S, onto which the image has been transferred by the second transfer device T2, on the surface thereof and transports the sheet S to the fixing device F.

The fixing device F heats the sheet S that passes through the fixing region Q5 while applying a pressure to the sheet S. Accordingly, the unfixed image on the surface of the sheet S is fixed to the sheet S. The sheet S to which the image has been fixed is transported to the downstream end of the feeding path SH2 in the transporting direction of the sheet S.

The switching gate GT1 at the downstream end of the feeding path SH2 in the transporting direction of the sheet S switches the destination of the sheet S between the ejection path SH3 and the reversing path SH4.

When the sheet S is to be ejected in a reversed manner or when double-sided printing is to be performed, the destination of the sheet S having an image recorded on one side thereof is switched to the reversing path SH4. Accordingly, the sheet S is transported to the reversing path SH4. The sheet S is transported along the reversing path SH4 by the reversing rollers Rb and passes through the Mylar gate GT2.

When the sheet S is to be ejected in a reversed state, the reversing rollers Rb start to rotate in the reverse direction after the upstream end of the sheet S in the transporting direction of the sheet S has passed the Mylar gate GT2. Accordingly, the sheet S is transported in the reverse direction in a so-called switchback manner. When double-sided printing is to be performed, the reversing rollers Rb start to rotate in the reverse direction after the upstream end of the sheet S in the transporting direction of the sheet S has passed the Mylar gate GT2 and the Mylar gate GT3, so that the sheet S is transported in the switchback manner.

The Mylar gate GT2 allows the sheet S that has been transported along the reversing path SH4 to pass therethrough. Then, the Mylar gate GT2 regulates the transporting direction of the sheet S transported in a switchback manner so as to guide the sheet S to the ejecting-reversing path SH5. Accordingly, the sheet S is guided from the ejecting-reversing path SH5 to the ejection path SH3.

The Mylar gate GT3 allows the sheet S that has been transported along the reversing path SH4 to pass therethrough. Then, the Mylar gate GT3 regulates the transporting direction of the sheet S transported in a switchback manner to guide the sheet S to the circulation path SH6.

The sheet S that has been transported to the circulation path SH6 is transported to the supply path SH1 in the sheet feeding device U2. Thus, the sheet S transported in the switchback manner is transported from the supply path SH1 to the registration roller Rr on the feeding path SH2 again in a reversed state. Accordingly, an image is recorded on a second side of the sheet S.

When the sheet S on which an image is recorded is ejected from the printer body U3, the destination of the sheet S is switched to the ejection path SH3. Accordingly, the sheet S having the image recorded thereon is guided to the ejection path SH3. The sheet S is transported along the ejection path SH3 by the transport rollers Ra, and ejected from the printer body U3 by the ejection roller Rh.

Structure of Finisher U4 of Exemplary Embodiment

Figure 2:
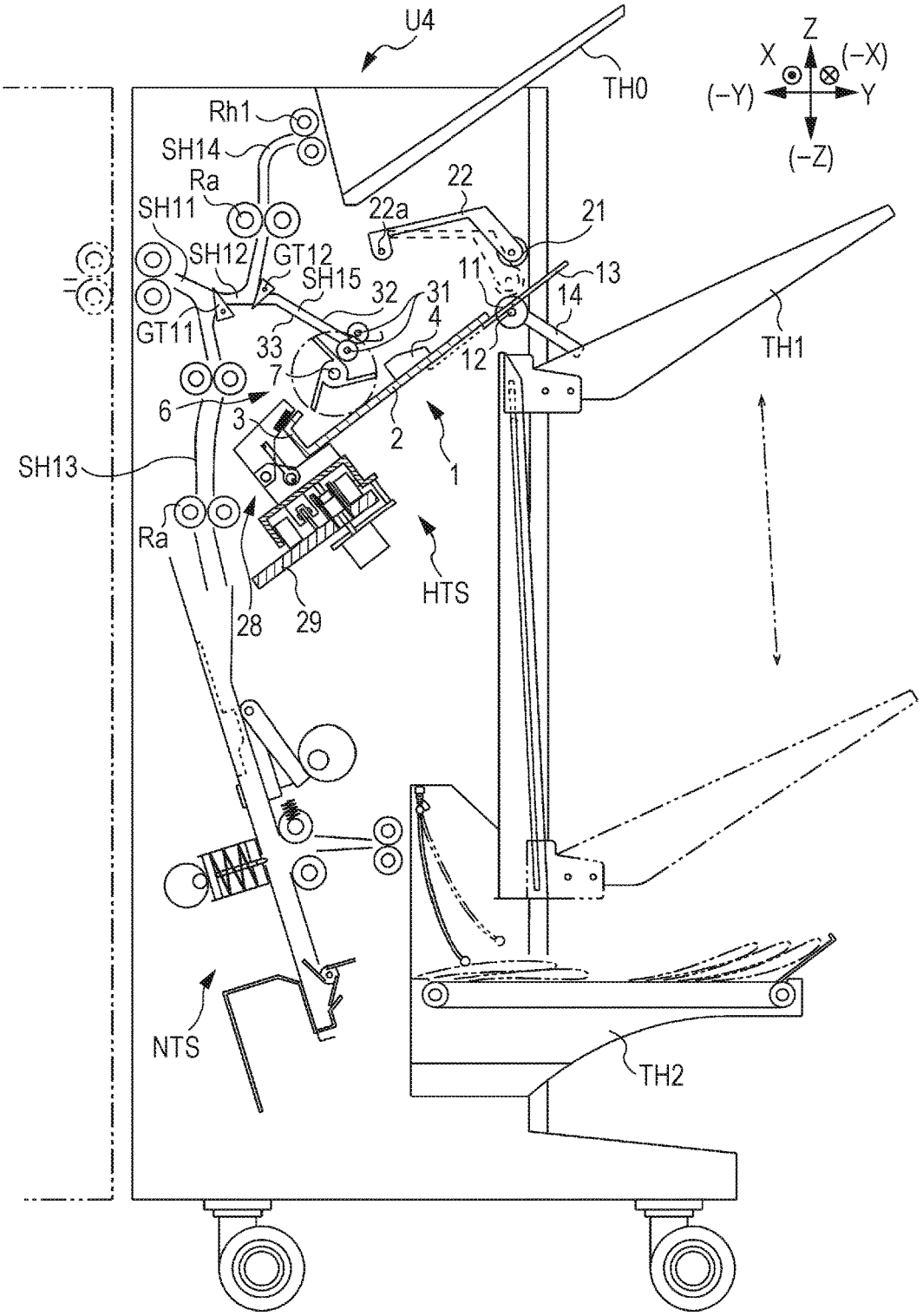
FIG. 2 illustrates a post-processing device according to the exemplary embodiment of the present invention.

FIG. 2 illustrates a post-processing device according to the exemplary embodiment of the present invention.

In FIGS. 1 and 2, the finisher U4, which is an example of a post-processing device, is disposed on the right side of the printer body U3. The finisher U4 includes a feeding path SH11, which is an example of a transport path. The feeding path SH11 extends into the finisher U4 from the downstream end of the ejection path SH3 of the printer body U3 in the transporting direction of the sheet S. An upstream end of a relay path SH12, which is an example of a transport path and which extends rightward, in the transporting direction of the sheet S is connected to the downstream end of the feeding path SH11 in the transporting direction of the sheet S. An upstream end of a saddle-stitching transport path SH13, which is an example of a transport path and which extends downward, in the transporting direction of the sheet S is also connected to the downstream end of the feeding path SH11 in the transporting direction of the sheet S.

An upstream end of an ejection path SH14, which is an example of a transport path and which extends upward, in the transporting direction of the sheet S is connected to the downstream end of the relay path SH12 in the transporting direction of the sheet S. An upstream end of an edge-binding transport path SH15, which is an example of a transport path and which extends rightward, in the transporting direction of the sheet S is connected to the downstream end of the relay path SH12 in the transporting direction of the sheet S.

A first gate GT11, which is an example of a destination switching member, is provided at a branching portion between the relay path SH12 and the saddle-stitching transport path SH13.

A second gate GT12, which is also an example of a destination switching member, is provided at a branching portion between the ejection path SH14 and the edge-binding transport path SH15.

An ejection roller Rh1, which is an example of an ejecting member, is arranged at the downstream end of the ejection path SH14 in the transporting direction of the sheet S. A top tray TH0, which is an example of a medium receiver, is supported at a location downstream of the ejection roller Rh1 in an ejecting direction in which the sheet S is ejected.

An edge binding device HTS is disposed downstream of the edge-binding transport path SH15 in the transporting direction of the sheet S. A stacker tray TH1, which is an example of an edge-binding receiver, is supported at a location downstream of the edge binding device HTS in the transporting direction of the sheet S. The stacker tray TH1 is supported in a vertically movable manner.

A saddle stitching device NTS is disposed downstream of the saddle-stitching transport path SH13 in the transporting direction of the sheet S. A saddle-stitching stacker tray TH2, which is an example of a saddle-stitching receiver, is supported at a location downstream of the saddle stitching device NTS in the transporting direction of the sheet S. The saddle stitching device NTS may have a well-known structure as those described in, for example, Japanese Unexamined Patent Application Publication Nos. 2003-089462, 2003-089463, 2006-69746, or 2006-69749, and detailed description of the saddle stitching device NTS is thus omitted.

Operation of Finisher U4 of Exemplary Embodiment

The sheet S transported from the printer body U3 is fed to the feeding path SH11 of the finisher U4. The sheet S fed to the feeding path SH11 is transported to the first gate GT11.

The first gate GT11 switches the destination of the sheet S between the relay path SH12 and the saddle-stitching transport path SH13 depending on the settings regarding post-processing.

The sheet S fed to the relay path SH12 is transported to the second gate GT12.

The second gate GT12 switches the destination of the sheet S between the ejection path SH14 and the edge-binding transport path SH15 depending on the settings regarding post-processing.

The sheet S fed to the ejection path SH14 is ejected to the top tray TH0 by the ejection roller Rh1.

The sheet S fed to the edge-binding transport path SH15 is transported to the edge binding device HTS.

The edge binding device HTS aligns the edges of plural sheets S and binds the edges of the sheets S together. The stack of sheets S processed by the edge binding device HTS is ejected to the stacker tray TH1.

When the stack of sheets S is placed on the stacker tray TH1, the stacker tray TH1 moves downward depending on the number of sheets S placed thereon.

The sheet S fed to the saddle-stitching transport path SH13 is transported to the saddle stitching device NTS.

The saddle stitching device NTS processes a stack of sheets S so as to bind the sheets S together at the center thereof in the transporting direction of the sheets S. The saddle stitching device NTS folds the stack of bound sheets S in half at the center and ejects the folded stack of sheets S to the saddle-stitching stacker tray TH2.

Edge Binding Device HTS of Exemplary Embodiment

Figure 3:
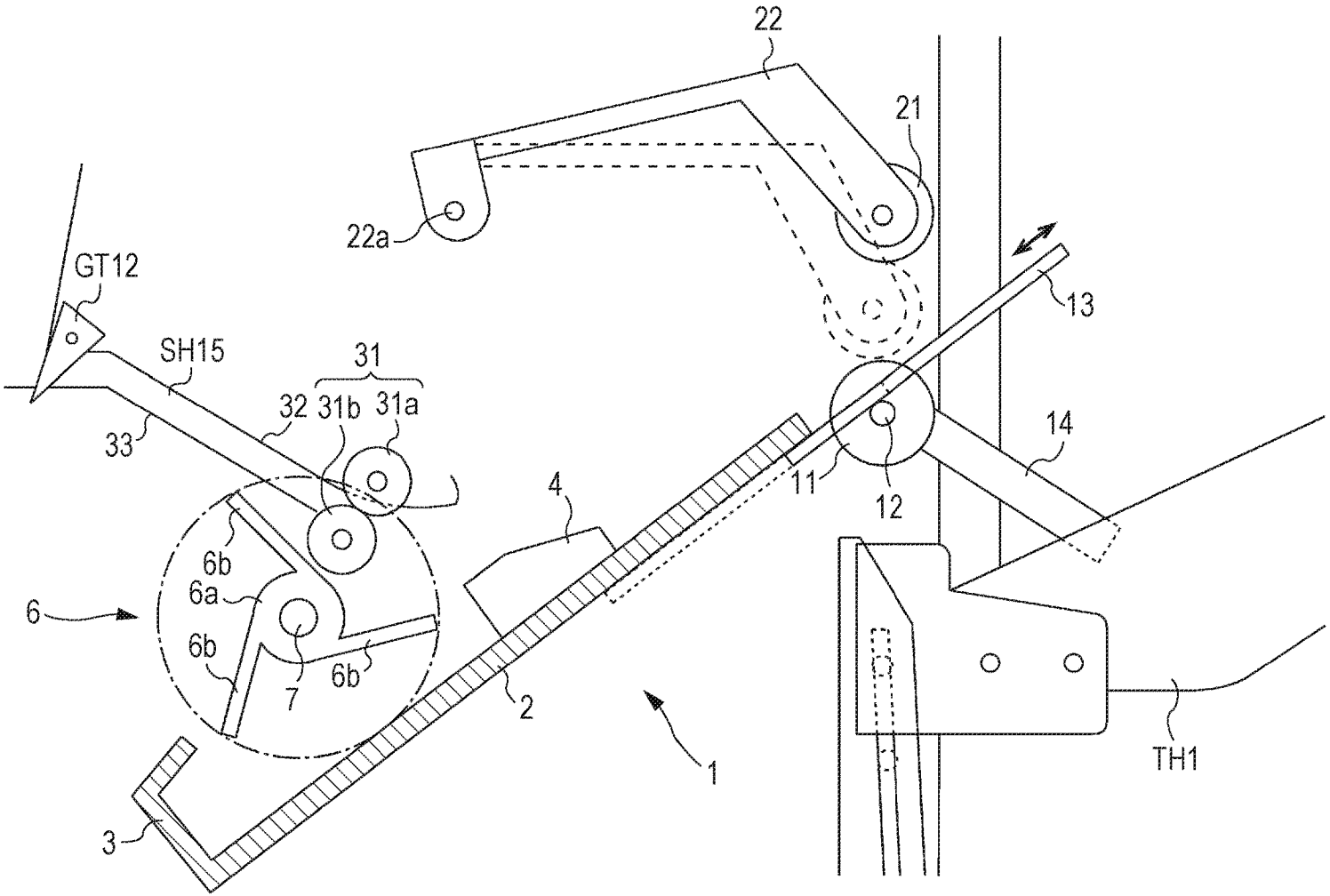
FIG. 3 illustrates an edge binding device according to the exemplary embodiment.

FIG. 3 illustrates the edge binding device HTS according to the exemplary embodiment.

Figure 4:
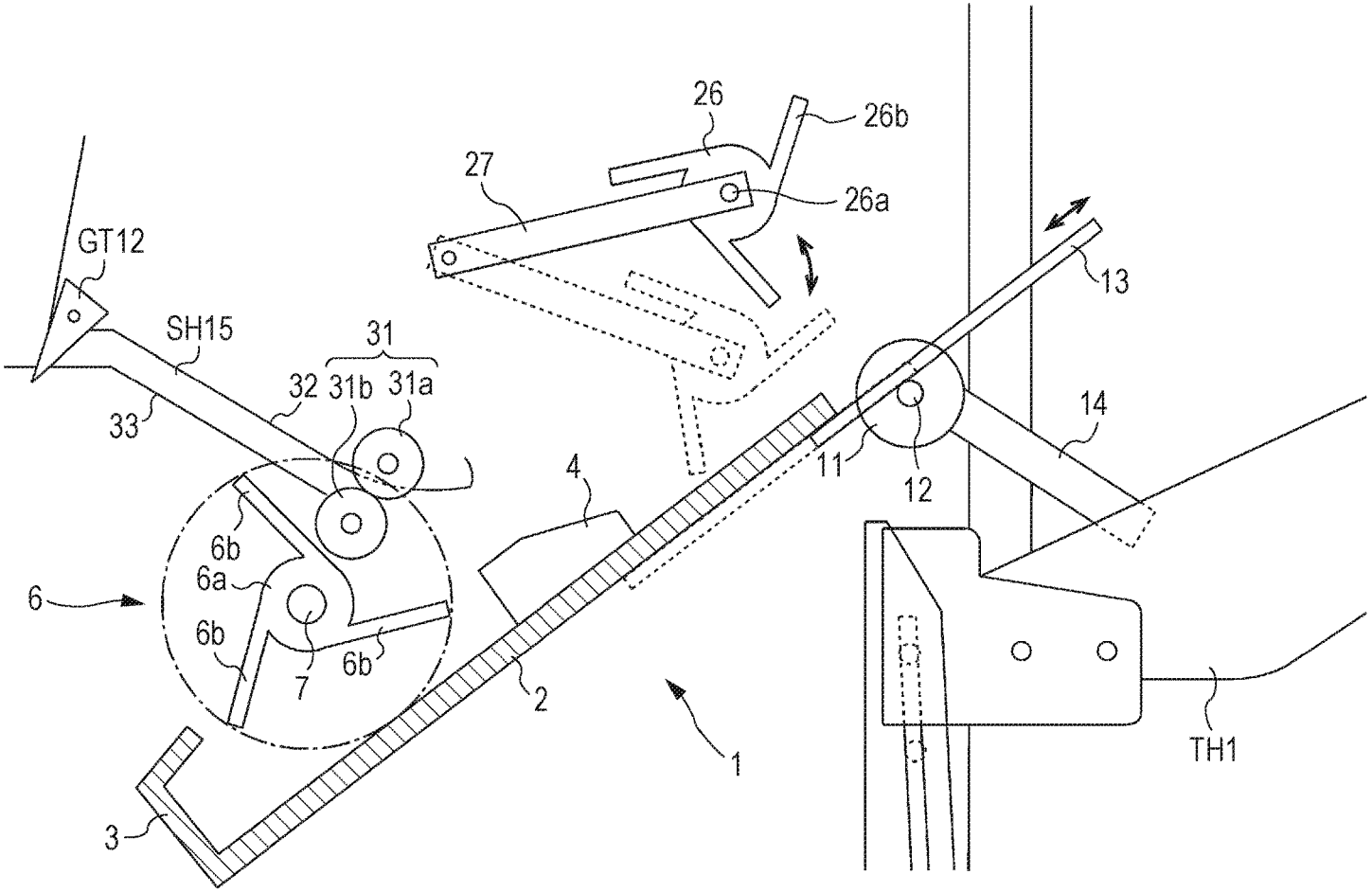
FIG. 4 illustrates the edge binding device according to the exemplary embodiment at a position shifted from the position of FIG. 3 in a front-back direction.

FIG. 4 illustrates the edge binding device HTS according to the exemplary embodiment at a position shifted from the position of FIG. 3 in a front-back direction.

Referring to FIGS. 2 to 4, the edge binding device HTS according to the exemplary embodiment includes a compiler tray 1 as a stacking portion. The compiler tray 1 includes a tray body 2 as an example of a stacking-portion body. The tray body 2 has the shape of a plate that extends from the lower left toward the upper right, that is, the shape of a plate inclined upward toward the downstream side in the transporting direction of the sheet S. The top surface of the tray body 2 is structured such that sheets S ejected from the edge-binding transport path SH15 are stackable thereon.

An end guide 3, which is an example of an aligning portion, is supported at the left end of the tray body 2. The end guide 3 extends in a direction toward the upper left that is perpendicular to the top surface of the tray body 2.

A pair of front and back tampers 4, which are examples of aligning members, are arranged on the tray body 2. The tampers 4 are supported so as to be movable toward and away from each other. The tampers 4 have the shape of a plate that extends in a direction toward the upper right that crosses the top surface of the tray body 2. Accordingly, the tampers 4 are capable of aligning the front and back edges of the sheets S stacked on the top surface of the tray body 2 by moving in the front-back direction.

Figure 5:
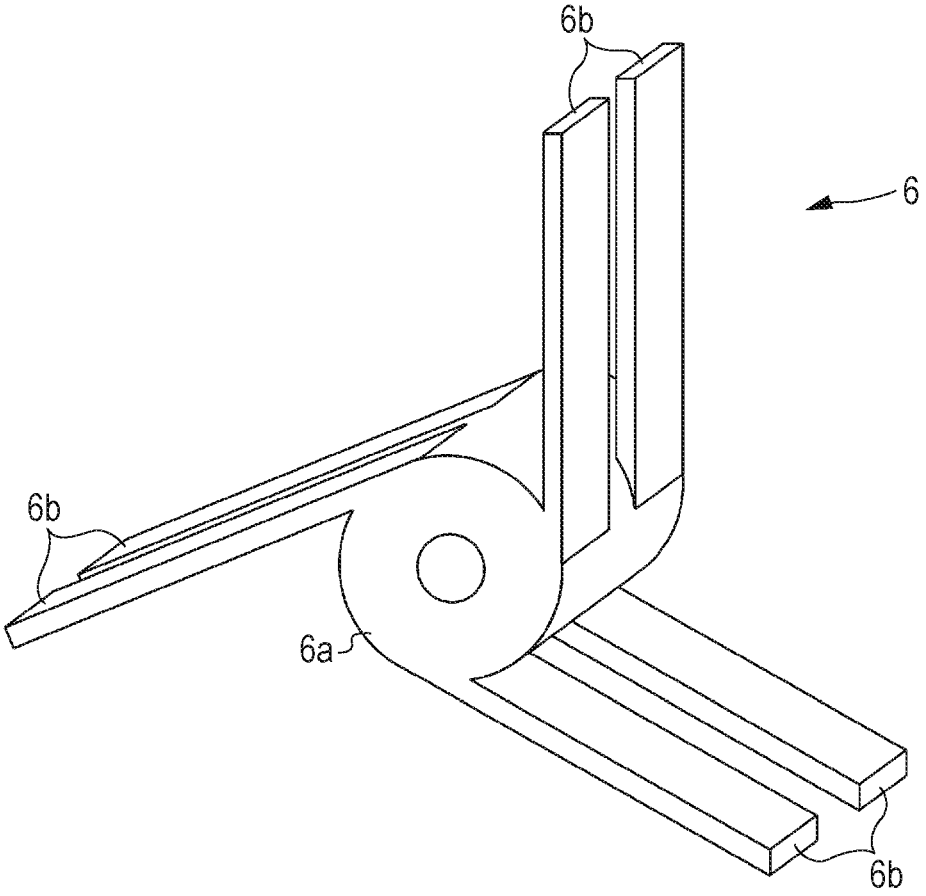
FIG. 5 illustrates a drawing member according to the exemplary embodiment.

FIG. 5 illustrates a drawing member according to the exemplary embodiment.

First paddle wheels 6, which are examples of drawing members, are disposed in an upper left region of the tray body 2. The first paddle wheels 6 are arranged at intervals in the front-back direction. Referring to FIGS. 4 and 5, each first paddle wheel 6 includes a shaft portion 6*a* supported by a rotating shaft 7 that extends in the front-back direction. The shaft portion 6*a* has a hollow cylindrical shape. Paddle bodies 6*b*, which are examples of drawing portions, are supported by the shaft portion 6*a*. The paddle bodies 6*b* extend radially outward from the shaft portion 6*a*. The paddle bodies 6*b* of the exemplary embodiment extend at an angle relative to the radial direction. More specifically, in the exemplary embodiment, pairs of front and back strip-shaped paddle bodies 6*b* are provided on a single shaft portion 6*a*. The paddle bodies 6*b* of the exemplary embodiment are flexible, and may be composed of, for example, rubber or film-shaped resin. The paddle bodies 6*b* may be formed integrally with the shaft portion 6*a*, or be formed as separate parts that are bonded to the shaft portion 6*a*. The first paddle wheel 6 according to the exemplary embodiment receives a driving force from a motor (not shown), which is an example of a driving source. The first paddle wheel 6 rotates in such a direction that the sheets S on the compiler tray 1 are transported toward the end guide 3.

Ejecting rollers 11, which are examples of ejecting members, are disposed at the right end of the tray body 2. The ejecting rollers 11 are arranged at intervals in the front-back direction. The ejecting rollers 11 are supported such that the ejecting rollers 11 are rotatable around a rotating shaft 12 that extends in the front-back direction. The rotating shaft 12 receives a driving force for forward or reverse rotation from a motor (not shown), which is an example of a driving source.

Extending members 13 are disposed near the rotating shaft 12. Each extending member 13 has gear teeth on the bottom surface thereof, the gear teeth meshing with a gear supported by the rotating shaft 12. Accordingly, each extending member 13 is supported such that, when the rotating shaft 12 is rotated in a forward or reverse direction, the extending member 13 is moved between an extended position shown by the solid lines in FIGS. 3 and 4 and a retracted position shown by the dashed lines in FIGS. 3 and 4. The extending members 13 are arranged at intervals in the front-back direction, and are disposed between the ejecting rollers 11 in the front-back direction.

Setting clamps 14, which are examples of pressing members, are rotatably supported by the rotating shaft 12. The setting clamps 14 according to the exemplary embodiment are arranged at intervals in the front-back direction. The setting clamps 14 are disposed between the ejecting rollers 11 and the extending members 13 in the front-back direction. Each setting clamp 14 is supported so as to be movable between a pressing position at which the setting clamp 14 comes into contact with and presses the top surface of the stack of sheets S ejected onto the stacker tray TH1 and a separated position at which the setting clamp 14 is separated from the sheets S. A solenoid, which is an example of a driving source, and a spring (not shown) are provided to enable each setting clamp 14 to move between the pressing position and the separated position. Each setting clamp 14 may instead be moved by driving the rotating shaft 12 in the forward or reverse direction by using a clutch, which is an example of a driving-force transmission switching member, or the like in place of the solenoid.

Referring to FIG. 3, clamp rollers 21, which are examples of clamping members, are disposed above the compiler tray 1. The clamp rollers 21 are arranged at intervals in the front-back direction so as to correspond to the ejecting rollers 11. The clamp rollers 21 are composed of driven rollers.

Each clamp roller 21 is rotatably supported by a first raising-lowering arm 22, which is an example of a raising-lowering member. The first raising-lowering arm 22 is supported such that the first raising-lowering arm 22 is rotatable around a rotation center 22*a* at the left end thereof. The first raising-lowering arm 22 is movable by a solenoid, which is an example of a driving source, and a spring (not shown) between an upper position shown by the solid line in FIG. 3 and a lower position shown by the dashed line in FIG. 3. At the upper position, the clamp roller 21 is separated from the corresponding ejecting roller 11. At the lower position, the clamp roller 21 is in contact with the corresponding ejecting roller 11, or the sheets S are clamped between the clamp roller 21 and the ejecting roller 11.

Referring to FIG. 4, second paddle wheels 26, which are examples of second drawing members, are disposed above the compiler tray 1. Similar to the first paddle wheels 6, each second paddle wheel 26 includes a shaft portion 26*a* and paddle bodies 26*b*.

Each second paddle wheel 26 is rotatably supported by a second raising-lowering arm 27, which is an example of a raising-lowering member. Similar to the first raising-lowering arm 22, the second raising-lowering arm 27 is movable by a solenoid and a spring (not shown) between an upper position shown by the solid line in FIG. 4 and a lower position shown by the dashed line in FIG. 4. At the upper position, the second paddle wheel 26 is separated from the sheets S stacked on the compiler tray 1. At the lower position, the second paddle wheel 26 may be in contact with the sheets S stacked on the compiler tray 1. A driving force is transmitted to the second paddle wheel 26 through a belt, a pulley, etc. (not shown), and the second paddle wheel 26 is rotated in a direction such that the sheets S are transported toward the end guide 3.

A stapler 28, which is an example of a binding member, is disposed on the left side of the end guide 3. The stapler 28 is movable along a guide rail 29, which extends in the front-back direction, to a position at which the sheets S are to be bound together. The stapler 28 is capable of binding the sheets S together with staples. The stapler 28 may have various well-known structures, such as that described in Japanese Unexamined Patent Application Publication No. 2003-089462, and detailed description thereof is thus omitted.

Figure 6:
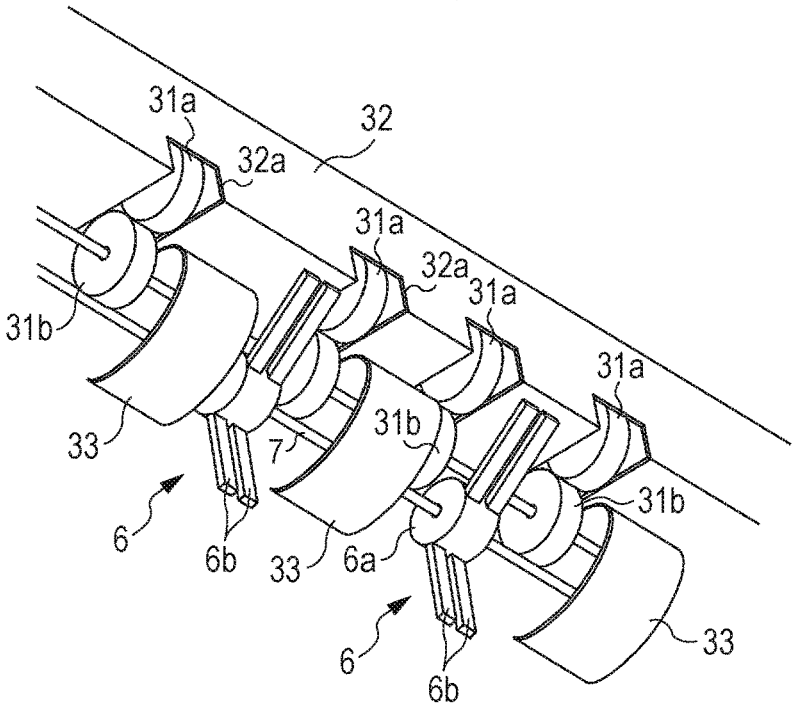
FIG. 6 is an enlarged view of a portion that ejects a medium to a stacking portion according to the exemplary embodiment.

FIG. 6 is an enlarged view of a portion that ejects a medium to a stacking portion according to the exemplary embodiment.

Figure 7:
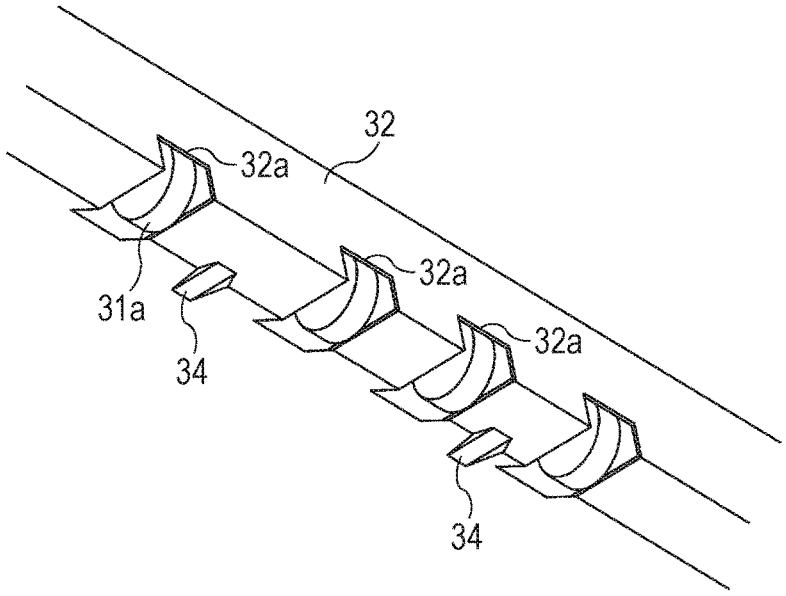
FIG. 7 illustrates an upper guiding member in the portion illustrated in FIG. 6 from which drawing members and driven members are removed.

FIG. 7 illustrates an upper guiding member in the portion illustrated in FIG. 6 from which drawing members and driven members are removed.

Referring to FIGS. 2 to 4, ejection roller units 31, which are examples of transporting members, are disposed in a downstream region of the edge-binding transport path SH15. Referring to FIGS. 3, 4, 6, and 7, each ejection roller unit 31 includes an upper driving roller 31*a*, which is an example of a driving member, and a lower driven roller 31*b*, which is an example of a driven member. A pair of upper and lower guides 32, which are examples of guiding members, are arranged along the edge-binding transport path SH15. Referring to FIGS. 6 and 7, the upper guide 32 has openings 32*a* arranged at intervals in the front-back direction. Lower portions of the driving rollers 31*a* of the ejection roller units 31 are disposed in the openings 32*a*. Referring to FIG. 6, the lower guide 33 includes portions arranged at intervals in the front-back direction at positions where the driven rollers 31*b* and the first paddle wheels 6 are not disposed.

Figure 8A:
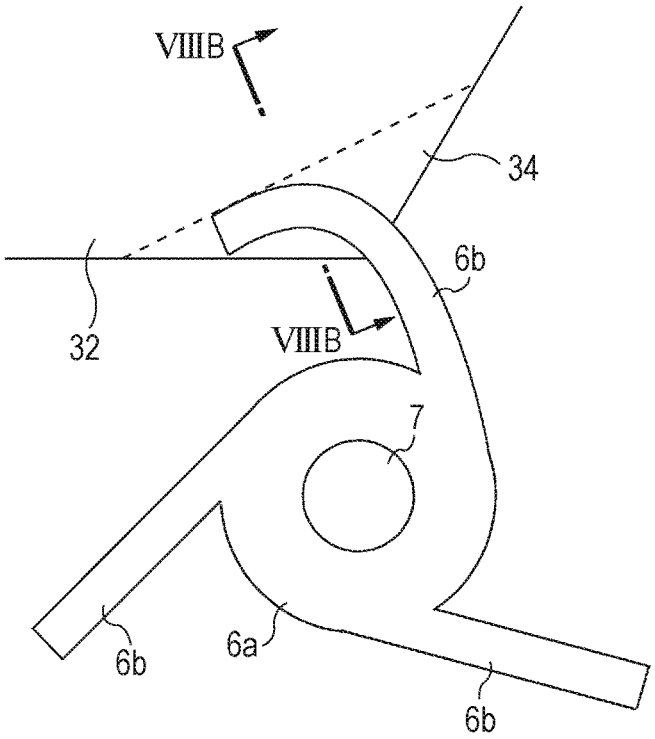
FIG. 8A is a side view illustrating a state in which a drawing portion of the drawing member according to the exemplary embodiment is in contact with a vicinity portion of a guiding member.
Figure 8B:
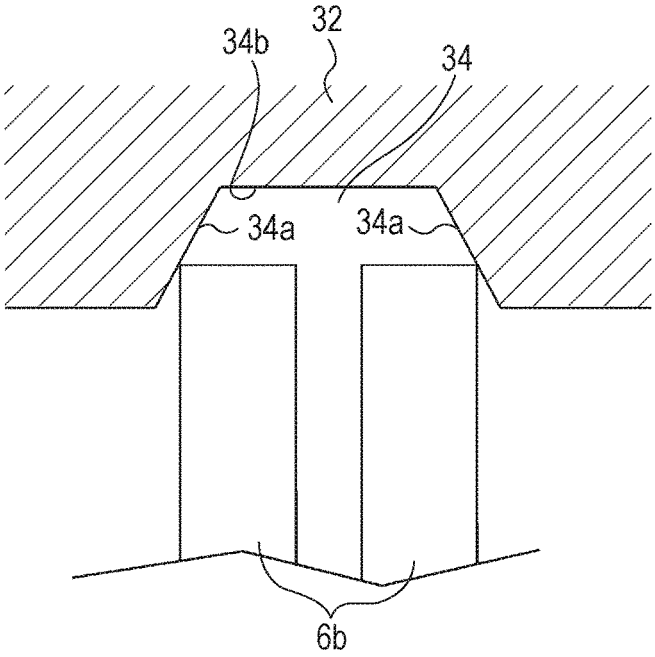
FIG. 8B is a sectional view taken along line VIIIB-VIIIB in FIG. 8A.

FIG. 8A is a side view illustrating a state in which a drawing portion of a drawing member according to the exemplary embodiment is in contact with a vicinity portion of a guiding member, and FIG. 8B is a sectional view taken along line VIIIB-VIIIB in FIG. 8A.

In FIG. 7, the upper guide 32 according to the exemplary embodiment includes recesses 34 as examples of vicinity portions. Referring to FIGS. 7, 8A, and 8B, the recesses 34 are recessed upward, that is, in a direction away from the rotating shaft 7 of the first paddle wheels 6. The recesses 34 are arranged at intervals in the front-back direction so as to correspond to the first paddle wheels 6. Referring to FIG. 8B, each recess 34 of the exemplary embodiment has tapered surfaces 34*a*, which are examples of oblique surfaces, at front and back ends thereof. The tapered surfaces 34*a* are at an angle relative to the front-back direction, which is the axial direction of the first paddle wheels 6, and are composed of oblique surfaces that obliquely extend from the surface of the upper guide 32 toward a bottom portion 34*b* of the recess 34. As illustrated in FIG. 8A, in the exemplary embodiment, the left and right ends of each recess 34, that is, the upstream and downstream ends of each recess 34 in the medium transporting direction, extend obliquely inward from the surface of the upper guide 32.

Operation of Edge Binding Device HTS of Exemplary Embodiment

In the edge binding device HTS according to the exemplary embodiment having the above-described structure, the sheets S are ejected to the compiler tray 1 when the settings are such that edge binding or set ejection, which is an operation of ejecting a stack of sheets S without binding the sheets S together after aligning the sheets S, is to be performed. The sheets S ejected onto the compiler tray 1 are drawn toward the end guide 3 when the paddle wheels 6 and 26 rotate. The sheets S are caused to abut against the end guide 3, so that the sheets S are aligned in the transporting direction of the sheets S. When the sheets S are stacked on the compiler tray 1, the tampers 4 are activated so that the sheets S are aligned in the width direction thereof.

In the case where the settings are such that set ejection is to be performed, when a single set of sheets S is placed on the compiler tray 1, the clamp rollers 21 move downward so that the sheets S are clamped between the ejecting rollers 11 and the clamp rollers 21. Then, the ejecting rollers 11 are activated so that the set of sheets S is ejected to the stacker tray TH1.

In the case where the settings are such that edge binding is to be performed, when a single set of sheets S is placed on the compiler tray 1, the stapler 28 is activated so that the sheets S are bound together with a staple at a set position. Similarly to the case in which set ejection is performed, the bound stack of sheets S is clamped between the clamp rollers 21 and the ejecting rollers 11 and ejected onto the stacker tray TH1.

Each time a stack of sheets S is ejected onto the stacker tray TH1, the setting clamp 14 comes into contact with the uppermost surface of the stack of sheets S to prevent the stack of sheets S ejected next from interfering with the stacks of sheets S that have already been ejected.

In the edge binding device HTS according to the exemplary embodiment, the first paddle wheels 6 are rotated when the sheets S are transported to the compiler tray 1. Here, in the exemplary embodiment, the rotation loci of the paddle bodies 6*b* of the first paddle wheels 6 extend to the recesses 34 in the upper guide 32 of the edge-binding transport path SH15. Therefore, in the exemplary embodiment, the distance between the downstream end of the edge-binding transport path SH15 and the compiler tray 1 is smaller than that in the case where the rotation loci of the paddle bodies 6*b* do not extend to the edge-binding transport path SH15. Accordingly, the time period from when a sheet S is ejected from the edge-binding transport path SH15 to when the sheet S falls onto the compiler tray 1 and is drawn toward the end guide 3 is reduced. As a result, the process speed per unit time, that is, productivity, is increased.

In particular, in the exemplary embodiment, the first paddle wheels 6 extend through the lower guide 33 and are in the vicinity of the upper guide 32. Therefore, the distance between the downstream end of the edge-binding transport path SH15 and the compiler tray 1 may be reduced from that in the case where the first paddle wheels 6 are in the vicinity of the lower guide 33. In the exemplary embodiment, the direction in which the first paddle wheels 6 rotate in the edge-binding transport path SH15 is the same as the transporting direction of the sheets S, so that the first paddle wheels 6 do not impede transportation of the sheets S.

In the exemplary embodiment, the recesses 34 are recessed so as to receive the first paddle wheels 6. When the recesses 34 are not formed, the amount by which the first paddle wheels 6 are bent when they come into contact with the upper guide 32 by a large amount. Accordingly, large noise is easily generated at the time of contact. In the exemplary embodiment, in which the recesses 34 are formed, the noise is reduced form that in the case where the recesses 34 are not formed.

Furthermore, the amount by which the paddle bodies 6*b* are bent when the paddle bodies 6*b* come into contact with the upper guide 32 is smaller than that in the case where the recesses 34 do not have the recessed shape. Therefore, the risk that the paddle bodies 6*b* will be plastically deformed over time and the ability thereof to draw the sheets S will be reduced is reduced.

In the exemplary embodiment, each recess 34 has the tapered surfaces 34*a*. When the tapered surfaces 34*a* are not formed, the paddle bodies 6*b* simultaneously come into contact with the recess 34 over the entire width thereof. Therefore, the noise generated when the paddle bodies 6*b* come into contact with the recess 34 easily increases. In contrast, when the tapered surfaces 34*a* are formed, the paddle bodies 6*b* do not simultaneously come into contact with the recess 34 over the entire width thereof, and the outer portions of the paddle bodies 6*b* in the width direction come into contact with the tapered surfaces 34*a* first. Therefore, in the exemplary embodiment, noise is smaller than that in the case where the tapered surfaces 34*a* are not formed.

In addition, in the exemplary embodiment, the upstream and downstream portions of each recess 34 in the transporting direction of the sheets S extend obliquely with respect to the surface of the upper guide 32. In other words, the upstream and downstream portions of each recess 34 are tapered. If the upstream and downstream ends of the recess 34 are stepped, the sheets S that are transported are easily caught by the stepped portions and jammed. In particular, the risk that the sheets S will be caught is higher at the downstream end, at which the sheets S move upward from the recess 34 toward the surface of the upper guide 32, than at the upstream end, at which the sheets S move downward from the surface of the upper guide 32 toward the recess 34. In the exemplary embodiment, the risk that a jam will occur is lower than that in the case where the upstream and downstream portions of the recess 34 are not tapered.

Modifications

Although an exemplary embodiment of the present invention has been described in detail, the present invention is not limited to the exemplary embodiment, and various modifications are possible within the scope of the present invention described in the claims. Exemplary modifications (H01) to (H05) of the present invention will be described.

(H01) In the exemplary embodiment, the printer U is described as an example of an image forming apparatus. However, the image forming apparatus is not limited to this, and may instead be another type of machine including a post-processing device, such as a copying machine, a facsimile machine, or a multifunction machine having the functions of these machines.

(H02) In the exemplary embodiment, each first paddle wheel 6 includes the paddle bodies 6*b* that extend from the shaft portion 6*a* at an angle relative to the radial direction. However, the first paddle wheel 6 is not limited to this, and may instead be structured such that the paddle bodies 6*b* extend in the radial direction.

(H03) In the exemplary embodiment, each first paddle wheel 6 extends into the edge-binding transport path SH15 and comes into contact with the corresponding recess 34 in the upper guide 32. However, the first paddle wheel 6 is not limited to this. Each first paddle wheel 6 may be structured so as not to extend into the edge-binding transport path SH15, and a corresponding recess may be formed in the lower guides 33.

(H04) Although the tapered surfaces 34*a* may be formed in the exemplary embodiment, the tapered surfaces 34*a* may be omitted. In addition, although the upstream and downstream portions of each recess 34 may be at an angle, they may instead be stepped.

(H05) Although the paddle bodies 6*b* come into contact with the recesses 34 in the exemplary embodiment, the configuration is not limited to this. For example, the configuration may instead be such that the paddle bodies 6*b* approach the recesses 34 but do not come into contact with the recesses 34, that is, such that the paddle bodies 6*b* come into contact with the upper guide 32 if the recesses 34 are not formed, but do not come into contact with the recesses 34 when the recesses 34 are formed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a stacking portion configured to stack a medium having an image recorded thereon;

an aligning portion that is disposed on the stacking portion and that is configured to align a position of an edge of the medium;

a drawing member configured to draw the medium stacked on the stacking portion toward the aligning portion; and a guiding member that is disposed above the drawing member and that is configured to guide the medium that is transported toward the stacking portion, the guiding member including a vicinity portion that is in a vicinity of the drawing member and that is recessed so as to be configured to receive the drawing member, wherein the drawing member includes:

a rotating shaft portion; and a drawing portion that extends in a radial direction from the rotating shaft portion and wherein the recessed vicinity portion comes into contact with the drawing portion and includes an oblique surface that is at an angle with respect to an axial direction of the rotating shaft portion.

2. The post-processing device according to claim 1, wherein a downstream portion of the vicinity portion in a direction in which the medium is transported is at an angle with respect to the direction in which the medium is transported.

3. An image forming apparatus comprising:

an image recording unit configured to record an image on a medium; and the post-processing device according to claim 1, wherein the post-processing device is configured to perform post-processing on the medium having the image recorded thereon by the image recording unit.

* * * * *